US010439301B2

(12) United States Patent
Kubiak

(10) Patent No.: US 10,439,301 B2
(45) Date of Patent: Oct. 8, 2019

(54) METHOD FOR PROTECTING ELECTRICAL CONNECTION BETWEEN ALUMINUM WIRE AND WINDING OF COIL BODY

(71) Applicant: HANNING ELEKTRO-WERKE GmbH & Co. KG, Oerlinghausen (DE)

(72) Inventor: Raphael Tobias Kubiak, Detmold (DE)

(73) Assignee: HANNING ELEKTRO-WERKE GmbH & Co. KG, Oerlinghausen (DE)

( * ) Notice: Subject to any disclaimer, the term of this patent is extended or adjusted under 35 U.S.C. 154(b) by 0 days.

(21) Appl. No.: 15/594,805

(22) Filed: May 15, 2017

(65) Prior Publication Data

US 2017/0346199 A1 Nov. 30, 2017

(30) Foreign Application Priority Data

May 27, 2016 (DE) ..... 10 2016 109 797
Mar. 29, 2017 (DE) ..... 10 2017 106 769

(51) Int. Cl.
*H01R 4/18* (2006.01)
*H01R 4/72* (2006.01)
(Continued)

(52) U.S. Cl.
CPC ..... *H01R 4/723* (2013.01); *H01B 1/023* (2013.01); *H01B 3/305* (2013.01); *H01F 5/04* (2013.01); *H01F 27/29* (2013.01); *H01F 41/10* (2013.01); *H01R 4/625* (2013.01); *H01R 4/72* (2013.01); *H01R 43/02* (2013.01); *H01R 43/0207* (2013.01)

(58) Field of Classification Search
CPC ..... H01R 4/72; H01R 4/723; H01R 4/726; H01R 43/02; H01R 43/0207; H01R 41/10; H01B 1/023; H01B 3/305; H01F 5/94; H01F 5/04; H01F 27/29
USPC ..... 439/730, 523, 932
See application file for complete search history.

(56) References Cited

U.S. PATENT DOCUMENTS 6,326,879 B1 12/2001 Hangmann et al.
6,370,760 B1 * 4/2002 Maldener ..... H02K 13/04 264/230

(Continued)

FOREIGN PATENT DOCUMENTS

CN 203953323 U 11/2014
CN 204741344 U 11/2015

(Continued)

OTHER PUBLICATIONS

English translation of European Search report for EP1165112 dated Oct. 5, 2007.*

(Continued)

*Primary Examiner* — Hae Moon Hyeon
(74) *Attorney, Agent, or Firm* — Patent Central LLC; Stephan A. Pendorf

(57) ABSTRACT

A method for contacting a wire (1), in particular an aluminum wire, with a connecting body (4), in particular with a plug of a coil body (5), comprising the following steps:

connecting the wire (1) materially to the connecting body (4) at at least one point (2, 3);

after connecting, enclosing a connecting region including the at least at one point (2, 3) by a shrink tube (6) with an inner glue (7), the shrink tube (6) encompassing the connecting body (4).

7 Claims, 4 Drawing Sheets

(51) Int. Cl.

| | |
|---|---|
| ***H01B 1/02*** | (2006.01) |
| ***H01B 3/30*** | (2006.01) |
| ***H01R 43/02*** | (2006.01) |
| ***H01F 5/04*** | (2006.01) |
| ***H01F 27/29*** | (2006.01) |
| ***H01F 41/10*** | (2006.01) |
| ***H01R 4/62*** | (2006.01) |

(56) References Cited

U.S. PATENT DOCUMENTS

| | | | | |
|---|---|---|---|---|
| 6,426,690 | B1 * | 7/2002 | Takenoshita | H01F 5/04 335/220 |
| 2008/0079328 | A1 * | 4/2008 | Shichijoh | H02K 3/28 310/184 |
| 2013/0113313 | A1 * | 5/2013 | Ikura | H02K 3/522 310/71 |
| 2015/0111442 | A1 | 4/2015 | Miyamoto et al. | |
| 2015/0130311 | A1 * | 5/2015 | Murakami | H02K 1/185 310/89 |

FOREIGN PATENT DOCUMENTS

| | | | |
|---|---|---|---|
| DE | 19852929 | C1 | 3/2000 |
| DE | 102008009620 | A1 | 8/2009 |
| JP | 2015026429 | A | 2/2015 |
| JP | 2015118826 | A | 6/2015 |

OTHER PUBLICATIONS

European Search Report dated Oct. 5, 2017, in European Application No. EP 17165112.

* cited by examiner

METHOD FOR PROTECTING ELECTRICAL CONNECTION BETWEEN ALUMINUM WIRE AND WINDING OF COIL BODY

BACKGROUND OF THE INVENTION

Field of the Invention

The invention relates to a contacting method for a wire, in particular an aluminum wire, which is connected to a connecting body, in particular a plug of a coil body. Furthermore, the invention relates to a connecting arrangement with the wire and the connecting body, as well as an electric pump motor which has the connecting arrangement.

Description of the Related Art

Various contacting methods are known from the prior art for connecting a wire, for example an aluminum wire used as a winding for an electric motor, to the terminal body and to protect the connection point formed between the wire and the terminal body. The connection is produced in the industrial environment, for example, by soldering or welding or ultrasonic bonding. It is also known to use a cutting clamping technique for connecting the wire to the connecting body.

Typically, the connection point between the wire and the connection body forms a weak point which is to be protected. In order to protect the connection point, it is known to coat it with thermoplastic or thermosetting materials, to cast it with epoxy or a similar material, or to apply a paint layer. It is also known from CN 204 741 344 U to apply a grease or other lubricant to the joint for protection of the joint. The material used here is silicon dioxide-thickened hydrocarbons, polydimethylsiloxane or a classic silicone.

Even though the known methods for producing a sheathing for the connection point have proven to be successful in practice, efforts are being made to further improve the contacting methods and to optimize the protection of the connection point, in particular due to the constantly evolving quality standards and new test routines (for example, salt spray testing).

BRIEF SUMMARY OF THE INVENTION

It is an object of the invention to provide a contacting method, a connecting arrangement and an electric pump motor in which the connecting point formed between the wire and the connecting body can be produced particularly economically and is advantageously protected against damaging environmental influences.

To achieve the object, the contacting method according to the invention has the features of patent claim 1.

In this case, the wire is connected materially to the connection body. After the connection has been established, a shrink tube with an inner glue is placed over the connection point.

Preferably, the shrink tube is heated after the enveloping. When the connecting point is sheathed with the shrink tubing, or more particularly when the shrink tubing is heated, a part of the thermoplastic inner adhesive can pass through a gap which is formed between the connecting body and the shrink tubing.

The particular advantage of the invention is that the connection point is electrically insulated in an excellent manner by the inner glue and the shrink tube. At the same time, the connection point and the part of the wire encompassed by the covering are protected against corrosion. The shrink tube with the inner glue prevents contact with oxygen or water. The shrink tube is also resistant to aging. The inner glue as well as the material properties of the shrink tube are used to prevent stress cracks or to minimize the tendency to embrittlement. The connection point is resistant to aggressive media such as oil, acid, alkali or salts. Furthermore, good temperature resistance is ensured in the normal operating temperature ranges of an aluminum winding for coil bodies. There is also no risk that the shrink tube will melt since it does not flow at temperatures above the crystalline melting point, but becomes elastic like an elastomer.

The good insulation also results in the wire, when it is designed as an aluminum varnish wire, requiring no additional insulation layer or additional insulation protection. Furthermore, the shrunk tube with which the connection is wrapped promotes an even and permanent action of force on the connecting points. It represents an additional mechanical safety device and guarantees a permanently good connection. Economically, investment costs in plant engineering are low. The connection process is easy to use and easy to handle. The cycle times are low.

The integral connection between the wire and the connecting body is produced, for example, by soldering or welding. For example, the wire can be bonded to the connector body. A bonding machine is used in particular when producing the bond connection. In doing so, the wire is pressed against the connecting body by a tool of the bonding machine and is excited by the tool to ultrasonic vibrations.

According to a further development of the invention, at least two connecting points are formed. The at least two and preferably all connection points are produced on a same side of the connection body.

Advantageously, a material connection with a low electrical transition resistance can be produced by the bonding of wire and connecting body. The reliability of the electrical connection improves as two or more connecting points are established between the wire and the terminal body. Economically advantageously, the two or more points are produced on a common side of the connecting body, since a repositioning of the connecting body and/or the wire can be avoided during the production of the connection.

Optionally it can be provided that the wire is at least coarsely positioned on the connecting body before bonding. For this purpose, the connecting body can provide guide means for the wire. For example, guide openings or recesses for the wire can be provided on the connecting body.

One possible application is in the area of the contacting of aluminum wire, for example aluminum wire for aluminum wire winding of an electric motor, in which the contact of the aluminum wire is produced by an ultrasonic wire bonding machine.

For the selection of the shrink tube, the geometry of the area to be insulated, i.e., the geometry of the connection body and the connection point, must be taken into account, as well as the quality required of the product. In this case, the continuous operating temperature of the shrink tube as well as the winding formed by the wire must be taken into account. Another important parameter is the volume to be protected, which the inner glue must seal. This must also be considered when selecting the shrink tubing.

The use of the shrink tube with the inner glue is very advantageous in terms of process technology since the inner glue and the shrink tube can be introduced in a common process step. An inner thermoplastic adhesive and, in particular, an inner adhesive based on polyamide can be used as the inner adhesive. For example, an ethylene-vinyl acetate copolymer (elastomer adhesive) can be used as an internal adhesive. Particularly when the thermoplastic inner adhesive is used, a melting point can be provided in the region of approximately 135° C.

During the testing of the contacting method according to the invention it has been found that a very good mechanical protection against shocks, vibrations and the like is produced. The electrically conductive connection is therefore permanently produced.

The connection arrangement according to the invention comprises, in this respect, a connection body and a wire firmly bonded to the connection body at a connection point in at least one connection point, as well as an enclosure for the connection point. The sheathing has a thermoplastic internal glue which surrounds the wire and the connecting body in the region of the connecting point, as well as a shrinking tube which surrounds the wire and the connecting body likewise in the region of the connecting point. For example, a flat plug or terminal of a coil body serves as a connection body.

The inner glue is preferably an elastomer adhesive or a thermoplastic inner glue and is provided between the connecting body and the shrink tube.

According to a preferred embodiment of the invention, the wire and the connecting body are bonded together at least at two points. According to the preferred embodiment of the invention, the two points are provided on a common side of the connecting body and preferably on a common flat side of the flat plug serving as a connecting body.

One use of the inventive contacting method is, in particular, for electric pump motors. Such pump motors have a connection arrangement according to the invention in that a wire of the windings is secured to a connecting body of the motor.

The integral connection between the wire and the connecting body can be produced according to the invention, for example, by welding or soldering and in particular by ultrasonic wire bonding.

BRIEF DESCRIPTION OF THE SEVERAL VIEWS OF THE DRAWINGS

Further advantages, features and details of the invention can be taken from the further subclaims and the following description. Characteristics mentioned there can each be relevant to the invention individually or in any desired combination. Characteristics and details of the connection arrangement described in the invention are, of course, also related to the method according to the invention and vice versa. Thus, the disclosure to the individual aspects of the invention can always be referred to as reciprocal. The drawings are given by way of example only and are not intended to be limiting.

DETAILED DESCRIPTION OF THE INVENTION

Figure 1:
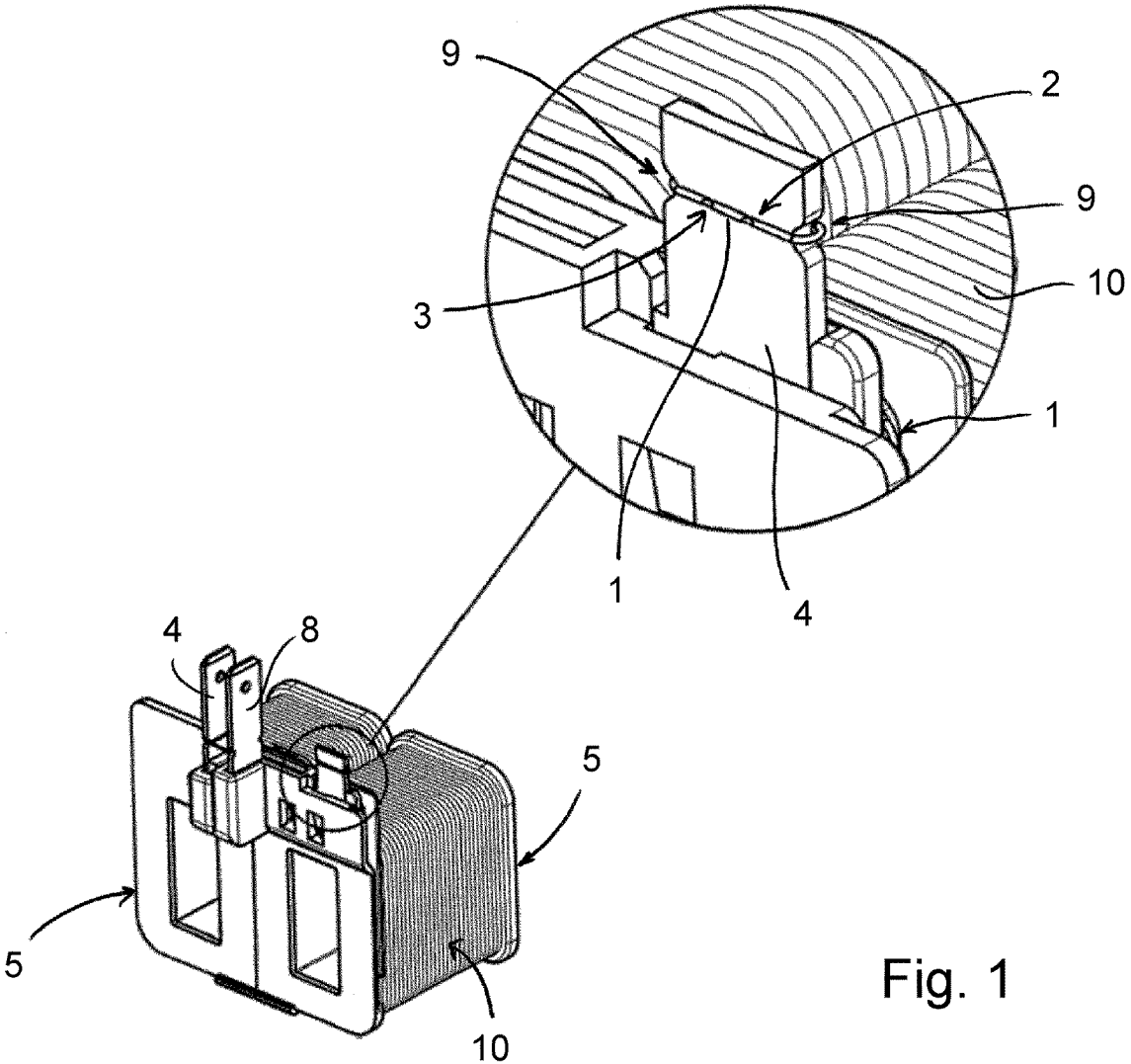
FIG. 1 a first process step in the production of a connecting arrangement according to the invention, FIG. 2 the connection arrangement according to FIG. 1 in the finished state, FIG. 3 a second embodiment of the connecting arrangement according to the invention FIG. 4 a schematic illustration of an ultrasonic bonding machine and method.
Figure 2:
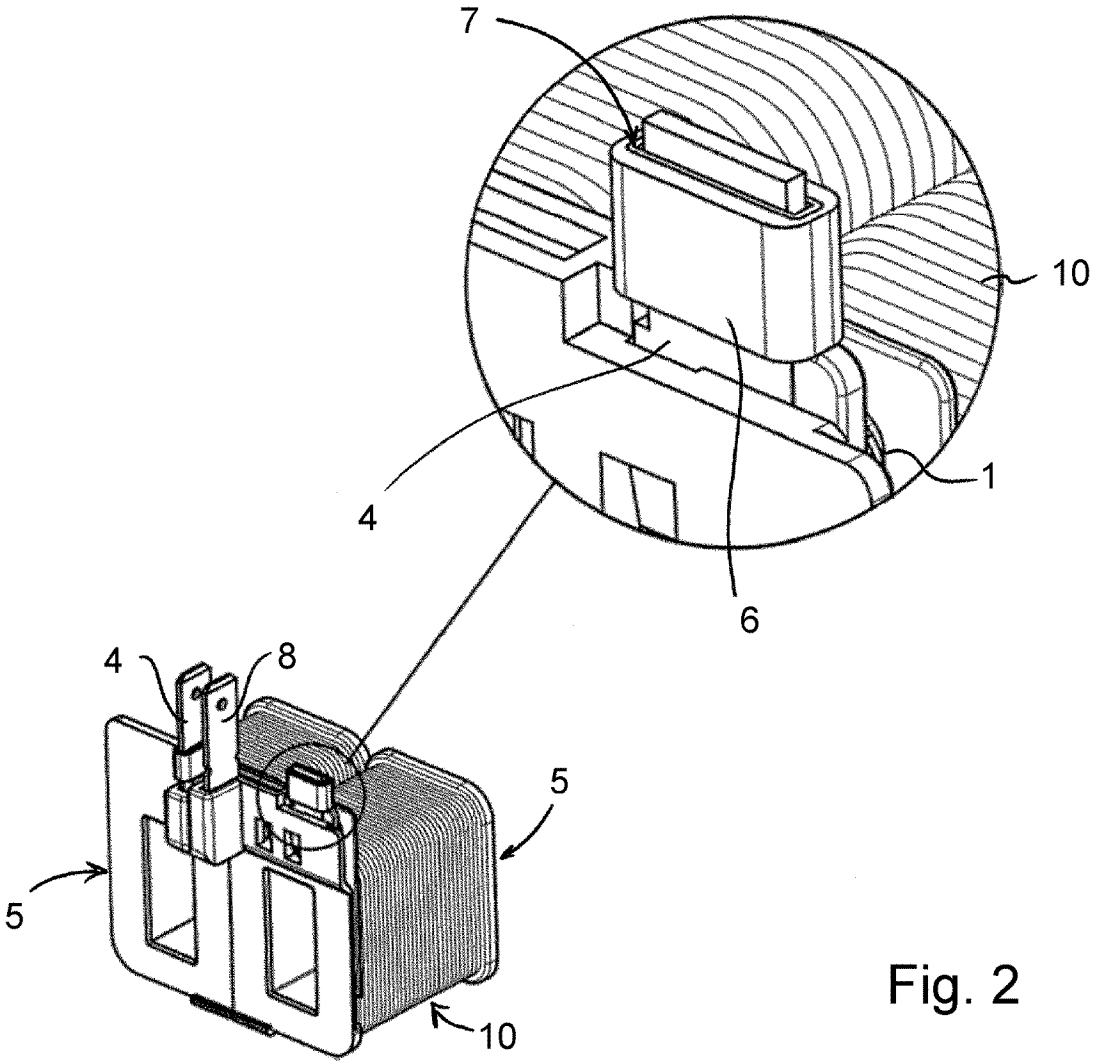

According to a first embodiment of the invention according to FIGS. 1 and 2, a connection arrangement according to the invention for an electric pump motor is pro Vided, which provides two connection bodies 4, which are made in the manner of a flat plug of an electrically conductive material. As part of the connecting arrangement, an aluminum wire 1 is also provided which, on the one hand, forms a winding 10 and, on the other hand, is connected in two points 2, 3 on the connecting body 4. The connecting points 2, 3 designed for the materially, electrically conductive connection of the wire 1 to the connecting body 4 are produced in the present exemplary embodiment of the invention by means of an ultrasonic wire bonding machine. In this case, the wire 1 is pressed against the connecting body 4 by a tool of the bonding machine, and the tool is excited to ultrasonic vibrations. Due to the ultrasonic vibrations, the wire 1 connects materially with the connecting body 4.

A securing of the wire 1 on the connecting body 4 according to FIG. 1 is achieved, in particular, before the bonding connection is produced, by winding the wire 1 around the connecting body 4 and positioning it in the region of two guide recesses 9, which are formed on two opposing narrow sides of the connecting body 4. The connecting points 2, 3 are provided on the same flat side of the connecting body 4 between the two guide recesses 9.

After the electrical connection between the wire 1 and the connection body 4 has been established, a shrink tube 6 with a thermoplastic inner glue 7 is introduced in the region of the connecting points 2, 3, which electrically insulates and encapsulates the connection point (see FIG. 2). The shrink tube 6 thereby encompasses the connecting body 4 with the wire 1 as well as the thermoplastic inner glue 7. The shrink tube 6 is heated after the covering has been produced. In the region of a gap formed between the connecting body 4 on the one hand and the shrinking tube 6 on the other hand, a part of the thermoplastic internal glue 7 emerges (not shown).

The two connecting bodies 4 are used for contacting the windings 10 supported by a coil body 5. In the present case, a further connecting body 8 is provided, which is not electrically contacted and remains non-functional in the illustrated embodiment.

Figure 3:
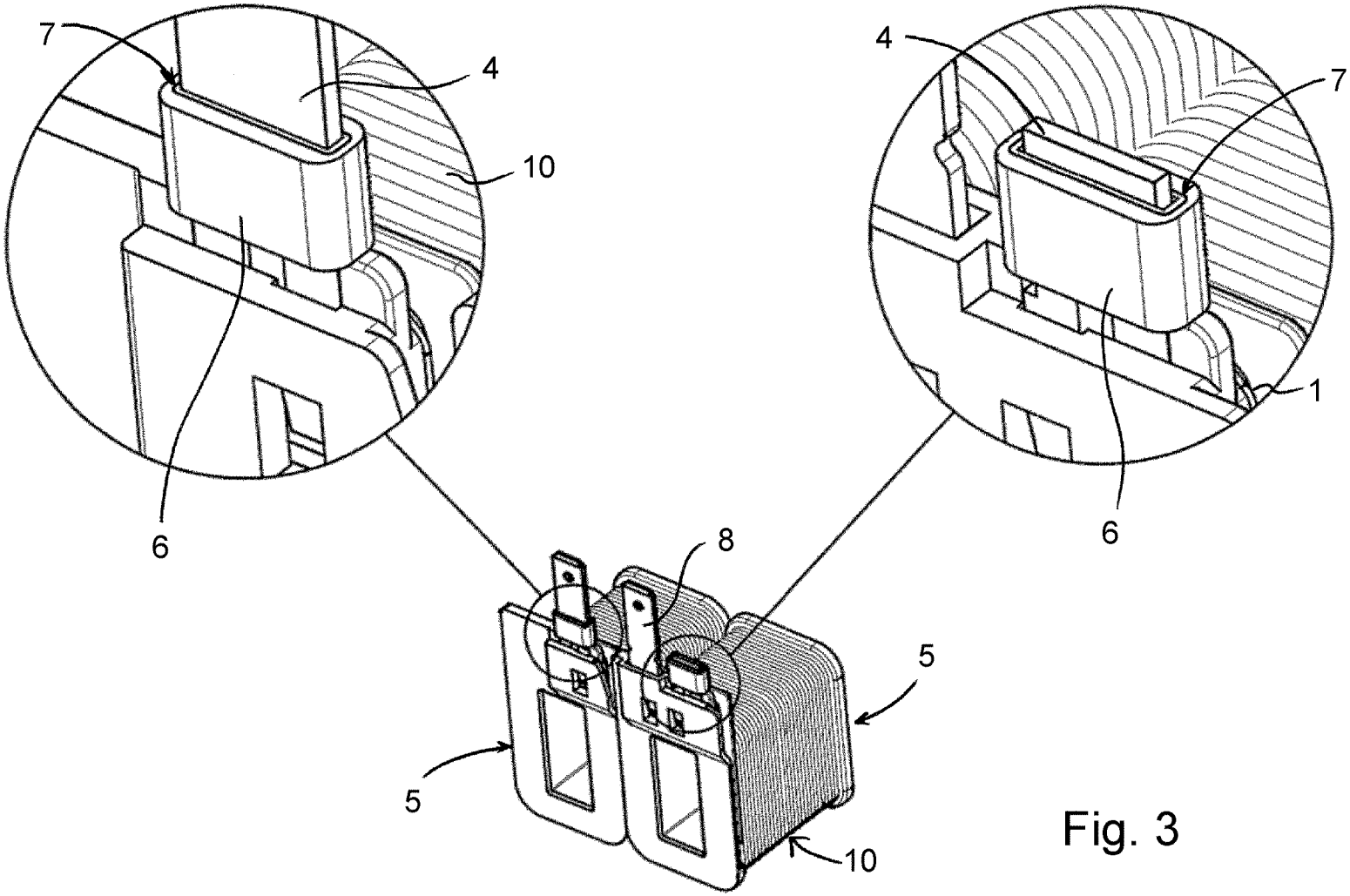
Figure 4:
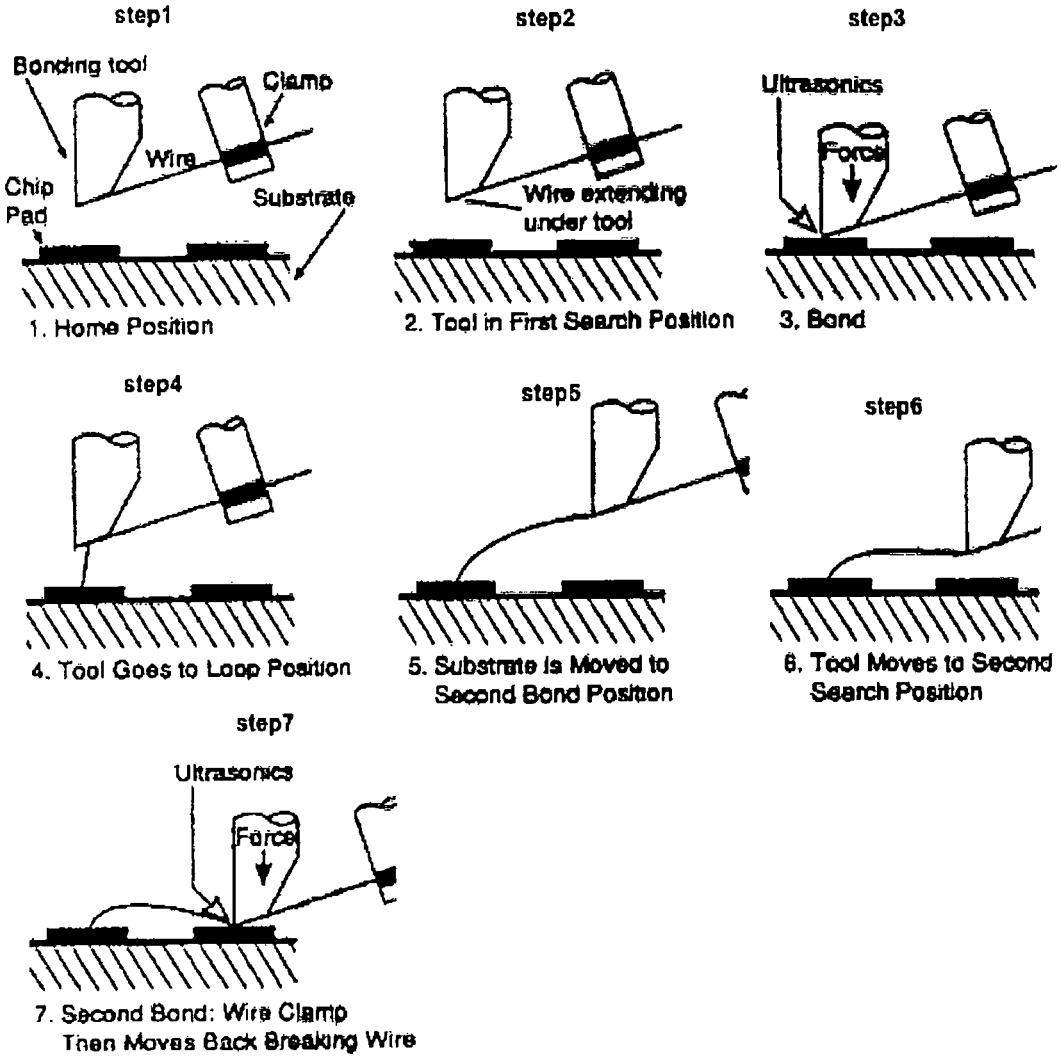
Fig. 4 PRIOR ART

According to a second embodiment of the invention as shown in FIG. 3, in a second connecting arrangement of the coil body 5 with the two connecting bodies 4, the two connecting bodies 4 designed as a flat plug are provided in a same orientation, whereas in the first exemplary embodiment of the invention the two connecting bodies 4 have an orientation to each other turned by 90° .

The invention is not limited to the embodiments discussed above and shown in the figures.

For example, the integral connection of the wire 1 with the connecting body 4 can be produced by a welding process as a welded connection point or by a soldering method as a soldered joint.

An elastomer adhesive can be provided as an internal adhesive and, in particular, an ethylene-vinyl acetate-based internal adhesive (ethylene-vinyl acetate copolymer).

Identical components and component functions are identified by the same reference symbols.

The invention is not limited to the embodiment shown here. In particular, the connecting body 4 can have a different geometry. Likewise, the method according to the invention is not limited to the ultrasonic bonding of aluminum wire 1.

The invention claimed is:

1. A connecting arrangement of an electric pump motor, comprising an aluminum wire (1) of a winding (10) which is provided on a coil body (5), and a connecting body (4) for electrically connecting the winding (10) with an external electrical supply, wherein the aluminum wire (1) of the winding (10) is welded with the connecting body (4) by means of a bonding machine, the aluminum wire (1) being pressed against the connecting body (4) by a tool of the bonding machine and excited by the tool to ultrasonic vibrations to form at least one weld, and, wherein the at least one weld is enveloped by enveloping means comprising a shrink tube (6) having an inner glue (7), the shrink tube (6) enveloping the aluminum wire (1) and the connecting body (4) at the at least one weld and heated to shrink the shrink tube (6).

2. The connecting arrangement according to claim 1, wherein the connecting body (4) is in the form of a flat plug connected to the coil body (5).

3. The electric pump motor according to claim 2, wherein the wire (1) is welded to the connecting body (4) at least two times on a same flat side of the flat plug.

4. The connecting arrangement according to claim 1, wherein the inner glue (7) is provided between the connecting body (4) and the shrink tube (6).

5. The connecting arrangement according to claim 1, wherein at least one of a thermoplastic inner glue and an elastomer glue is provided as the inner glue (7).

6. The connecting arrangement according to claim 1, wherein a thermoplastic adhesive based on polyamide or an ethylene vinyl acetate based elastomeric adhesive is used as an inner glue (7) for the shrink tubing (6).

7. The connecting arrangement according to claim 1, wherein the at least one weld is more than one weld produced on a same flat side of the connecting body (4).

* * * * *